United States Patent [19]

Rohner et al.

[11] 4,217,749

[45] Aug. 19, 1980

[54] METHOD AND APPARATUS FOR JOINING TEXTILE THREADS

[75] Inventors: Joachim Rohner; Reinhard Mauries; Heinz Zümfeld, all of Mönchen-Gladbach, Fed. Rep. of Germany

[73] Assignee: W. Schlafhorst & Co., Monchen-Gladbach, Fed. Rep. of Germany

[21] Appl. No.: 960,635.

[22] Filed: Nov. 14, 1978

[30] Foreign Application Priority Data

Nov. 14, 1977 [DE] Fed. Rep. of Germany ..... 2750913

[51] Int. Cl.[2] ..... D01H 15/00

[52] U.S. Cl. ..... 57/261; 57/22

[58] Field of Search ..... 57/22, 261; 242/35.5 R, 242/35.6 R

[56] References Cited

U.S. PATENT DOCUMENTS

| | | | |
|---|---|---|---|
| 3,233,636 | 2/1966 | Bulock | 242/35.6 R X |
| 3,273,330 | 9/1966 | Gonsalves | 57/22 |
| 3,565,358 | 2/1971 | Repka | 242/35.6 R |
| 3,918,651 | 11/1975 | Uchida | 242/35.6 R |
| 4,121,409 | 10/1978 | Uchida et al. | 57/261 X |

*Primary Examiner*—Donald Watkins

*Attorney, Agent, or Firm*—Herbert L. Lerner

[57] ABSTRACT

Method of joining textile threads by means of an apparatus having a vortex chamber formed with an elongated slot for introducing therein threads that are to be joined, the threads being insertable into the vortex chamber adjacent one another and being held by clamping devices outside the vortex chamber, the threads being twistable together in the vortex chamber by compressed air supplied thereto and being thereby joined, which includes inserting the threads to be joined loosely and without tension into the vortex chamber so as to be looped about opposite end rims of the vortex chamber; twisting together the threads disposed loosely and without tension in the vortex chamber while they are tightly held by the clamping devices and slackening the thread tension to such an extent that a false twist imposed on the textile threads during twisting together of the threads and consequent shortening of the thread length causes the textile threads to come into contact with the end rims of the vortex chamber.

10 Claims, 7 Drawing Figures

FIG. 4
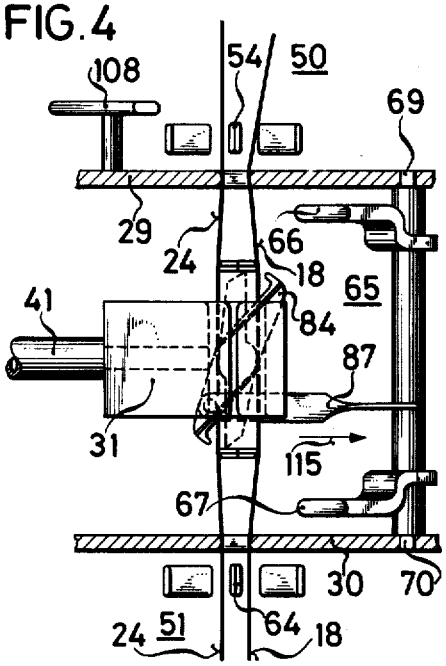
FIG. 5
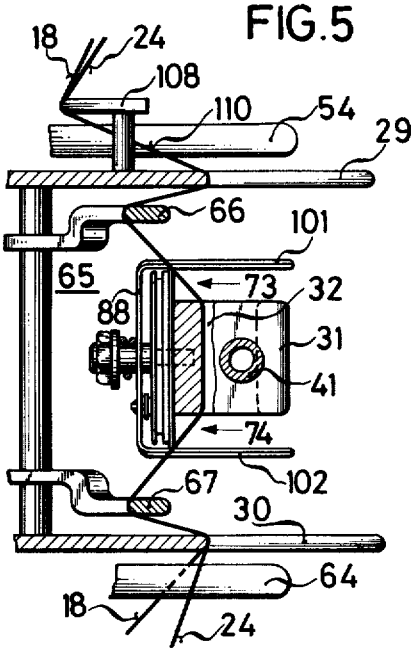
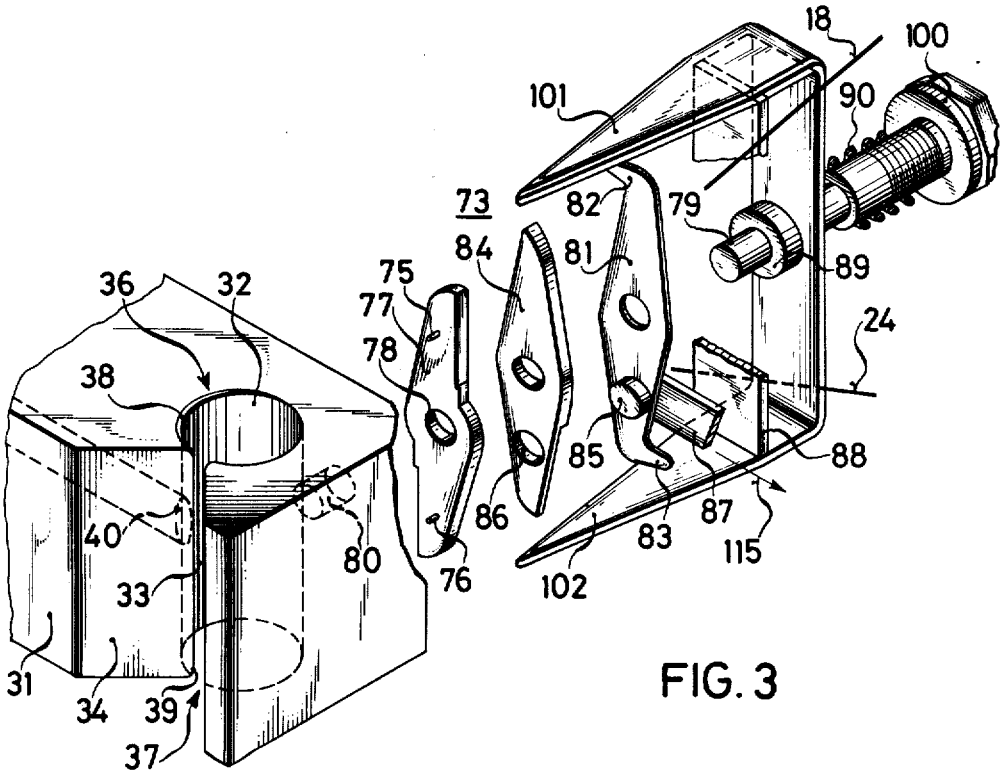
FIG. 3

METHOD AND APPARATUS FOR JOINING TEXTILE THREADS

The invention relates to a method of joining or connecting textile threads and apparatus for performing the method which has a vortex chamber formed with a longitudinal slot for inserting and removing the threads to be joined, the threads being insertable adjacent one another and being held by thread clamping devices located outside the vortex chamber, the threads being twisted together in the vortex chamber by compressed air supplied thereto and being joined together in this manner.

In a heretofore known apparatus of the aforementioned type, thread clamping devices are provided in axial direction of the vortex chamber in front of and behind the end rims of the vortex chamber, which hold the thread to be joined together in such a manner that, in stretched condition, they are disposed approximately in the longitudinal axis of the whirl chamber. The instant compressed air is blown into the vortex chamber, the strands of the threads become twisted together and, simultaneously, a false twist is imposed thereon which continues up to the thread clamping devices.

The thread joint or connection obtained by such an apparatus has various disadvantages. The joint or connecting location itself is very long and extends from one thread clamping device to the other. The desired twisting occurs only inside the vortex chamber, however, so that, in fact, double the thread cross section with false twist exists at the ends of the joint or connecting location, but not the desired thorough intermixture of the individual fibers. In order to be able to hold the thread strands at all, free thread ends of sufficient length must project from the thrad clamping device during the holding operation. These thread ends are not joined or connected to the adjacent strand at all and in addition, have a very disturbing effect.

It is an object of the invention to provide a method and apparatus for effecting joint or connection of textile threads which has a limited length as compared to the thickness of the thread and is formed along the entire length of the joint or connection of twisted individual fibers, the joint or connection having the same tensile strength as the individual threads themselves.

With the foregoing and other objects in view, there is provided, in accordance with the invention, a method of joining textile threads by means of an apparatus having a vortex chamber formed with an elongated slot for introducing therein threads that are to be joined, the threads being insertable into the vortex chamber adjacent one another and being held by clamping devices outside the vortex chamber, the threads being twistable together in the vortex chamber by compressed air supplied thereto and being thereby joined, which comprises inserting the threads to be joined loosely and without tension into the vortex chamber so as to be looped about opposite end rims of the vortex chamber; twisting together the threads disposed loosely and without tension in the vortex chamber while they are tightly held by the clamping devices, and slackening the thread tension to such an extent that a false twist imposed on the textile threads during twisting together of the threads and consequent shortening of the thread length causes the textile threads to come into contact with the end rims of the vortex chamber. By means of the invention, a joint or connection of textile threads is obtained which is twisted along the entire length thereof, the length of the joint or connection being limited and determined by the length of the vortex chamber per se.

In order to mechanize the operations advantageously, there is provided in accordance with another mode of the invention, an improved method which comprises receiving and holding fast a thread end of a take-up thread by means of a pivotable thread holder and receiving and holding fast a thread end of a supply thread by means of another pivotable thread holder for inserting the respective threads into the vortex chamber; from a starting position placing the arms of a double-armed thread regulator at opposite sides of the vortex chamber against the threads projecting beyond the end rims of the vortex chamber and bringing the thread regulator into an end position thereof wherein the threads have become looped about the end rims of the vortex chamber; simultaneously closing the thread clamping devices that had remained open until then; returning the thread regulator to an intermediate position between the end position and the starting position thereof; thereafter performing the twisting together of the threads in the vortex chamber by supplying compressed air into the vortex chamber; reopening the thread clamping devices; and severing, at a location beyond the twisted-together connection, the thread ends that remain held by the pivotable thread holders.

While the emphasis has been placed heretofore on guiding the textile threads to be joined in axial direction of the vortex chamber, this axial guidance is now completely dispensed with and provision is made intentionally that, during the twisting process, contact of the thread strands with the end rims of the vortex chamber occurs. Due to these measures, the joint or connection location becomes extrenely strong and durable owing to the fact that the imposed false twist is arrested at the end rims of the vortex chamber and an especially intensive joining or connection of the individual fibers occurs at these end rims.

For implementing the method, according to the invention, there is provided an apparatus comprising a vortex chamber formed with a cylindrical inner space, an elongated slot through which the textile threads to be joined are insertable into the inner space of the vortex chamber and channel terminating tangentially at the cylindrical inner space for supplying compressed air thereto, the vortex chamber having end rims at opposite ends of the cylindrical inner space, respective thread clamping devices disposed outside each of the opposite end rims of the vortex chamber, a double-armed thread regulator movable between the vortex chamber and the thread clamping devices automatically from a starting position to an end position and from the latter position to an intermediate position and back again to the starting position so as to intersect a travel path of the threads to be joined for forming loops thereof at the end rims of the vortex chamber; and respective thread severing means for severing respective ends of the textile threads, the thread severing means, respectively, being disposed in the travel path between the arms of the double-armed thread regulator and both of the end rims of the vortex chamber. This apparatus is capable of performing an automatic operating cycle starting with the preparation or make-ready of the threads, through the twisting per se and subsequent severance of the thread ends, to the release of the thread strand.

In accordance with another feature of the invention, the thread severing means, respectively, are located directly at the end rims of the vortex chamber.

In accordance with a further feature of the invention, the thread severing means comprise a double shears having a movable severing knife pivotally mounted on a central support shaft.

In accordance with an added feature of the invention, the apparatus including thread guide means operatively associated with the thread severing means.

In accordance with an additional feature of the invention, the vortex chamber is formed with outwardly flaring beveled surfaces and rounded edges at the end rims and the elongated slot.

In accordance with yet another feature of the invention, each of the thread clamping devices has a first movable, controllable thread clamp for one of the threads to be joined, a second movable, controllable thread clamp for the other of the threads to be joined, and a stationary middle member for separating the threads from one another and for cooperating in common with both the first and second clamps to clamp the threads therebetween.

In accordance with yet a further feature of the invention, a line along a shortest possible uninfluenced thread travel path between a device for supplying one of the threads to be joined and a device for withdrawing the other of the threads to be joined extends outside the vortex chamber and in front of the apparatus for joining the threads.

In accordance with a concomitant feature of the invention, the apparatus includes thread holding means for receiving and holding fast one of the threads to be joined, and thread loop pulling device disposed in the travel path of the one of the threads to be joined, the thread loop pulling device being controllable and coordinated with a course of travel of the thread holding means for the one thread to be joined.

Short or even no troublesome thread ends at all are obtained if the thread severance means or shears are located directly at the end rims of the vortex chamber. This is possible, for example, by providing pivotable cutter or shearing blades, with which thread guides are associated which grip the thread end to be severed when the cutters or shears are actuated, and feed the thread end to the cutter blades. It is advantageous separately to grip the textile threads to be joined, to hold and clamp them separately and to place them together only in the vicinity of the vortex chamber. A false twist imposed upon the joint or connection location cannot propagate or continue because the individual threads are separated outside the vortex chamber.

The invention also permits the joined thread string or strand to be withdrawn from the vortex chamber after the thread clamping devices have opened, due to the resumed winding tension and the transverse force exerted thereby on the string of thread, and to be removed from the thread-joining apparatus without any special auxiliary means. This apparatus can be of the type that travels from work station to work station. For receiving and holding the thread ends as well as for inserting the threads into the thread clamping devices and the vortex chamber, pivotable thread holders operated by suction air are used. If suction air flows into such a thread holder only intermittently for the purpose of saving energy or for other reasons, and the thread is otherwise held machanically, it is advantageous to insert into the path of the thread a separate, controlled and, if desired, resilient thread loop puller which is coordinated with the motion cycle of the thread holder, as aforementioned. Such a thread loop puller has the function of again releasing, in a controlled or resiliently yielding manner, a predetermined length of the thread for forming the thread loop at the end rims of the vortex chamber.

Other features which are considered as characteristic for the invention are set forth in the appended claims.

Although the invention is illustrated and described herein as embodied in a method and apparatus for joining textile threads, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 3 is an enlarged exploded, fragmentary perspective view of the apparatus of the invention;

FIG. 4 is a fragmentary vertical sectional view of FIG. 1 at a given phase of operation thereof; and FIGS. 5 to 7 are a vertical sectional view of FIG. 4 taken perpendicularly thereto and showing the apparatus at different additional phases of operaton thereof.

Figure 1:
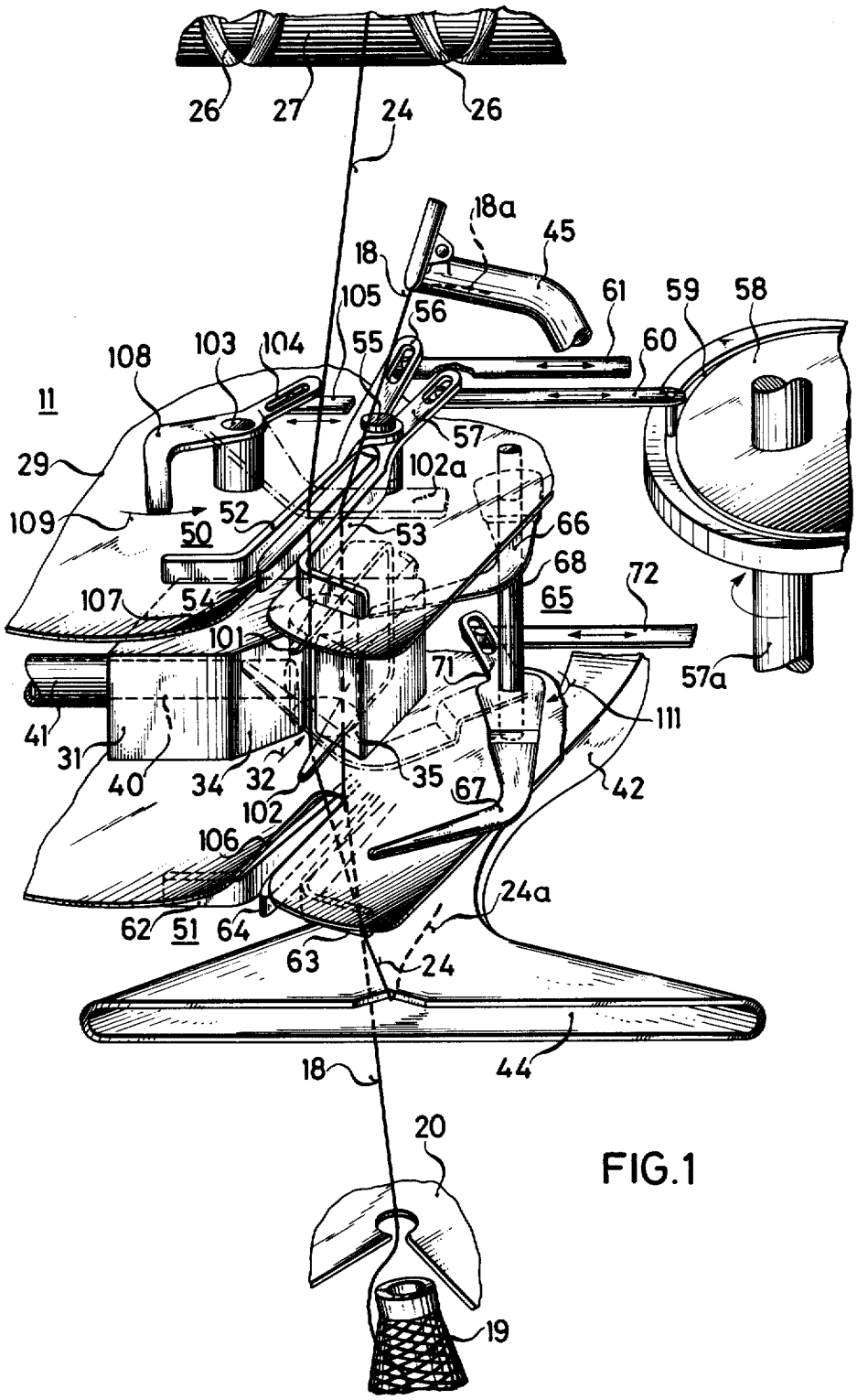
FIG. 1 is a perspective view of apparatus for joining or connecting textile threads according to the invention.
Figure 2:
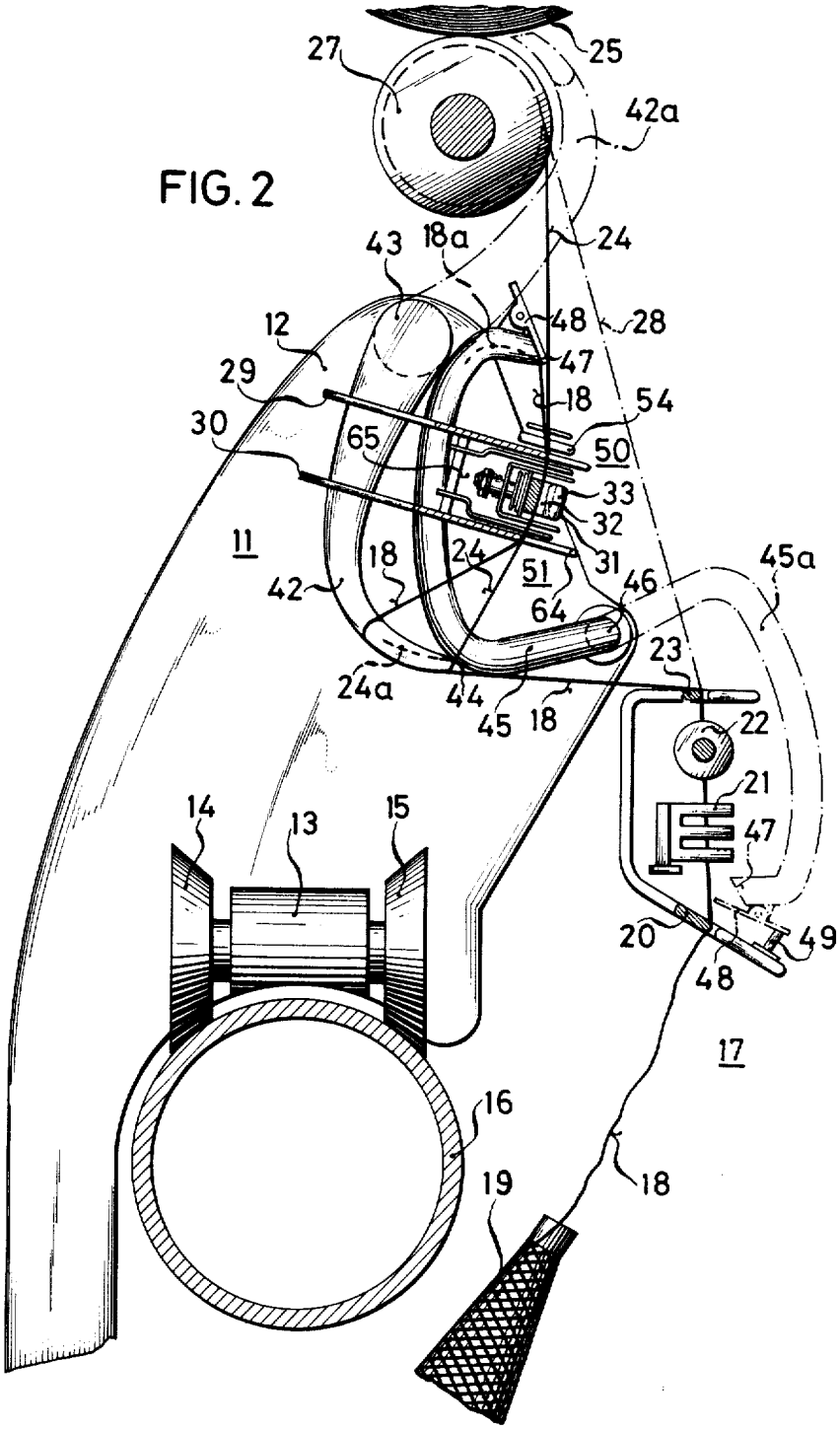
FIG. 2 is a side elevational view of FIG. 1.

Referring now to the drawing and first, particularly, to FIGS. 1 and 2 thereof, there is shown an apparatus 11 for joining or connecting textile threads or yarns. The apparatus 11 has a machine frame 12 which, as shown in FIG. 2, supports an undercarriage 13. The undercarriage 13 has rolls or wheels 14 and 15, by means of which, the apparatus 11 is able to travel on a support tube 16.

The support tube 16 is installed alongside a winding machine, of which only one winding station 17 is visible in FIG. 2. The apparatus 11 is shown to be in operation at this winding station 17.

A lower thread 18 is delivered to the device 11 from a supply coil or cop 19 through a thread guide 20, a conventional rake-type sensor 21, a thread brake 22 and another thread guide 23.

An upper thread 24 is delivered likewise to the apparatus 11 from a take-up coil 25 through a thread guide cylinder 27 equipped with conventional reverse winding grooves 26.

All of the illustrated objects or parts 18 to 27 belong to the winding station 17.

In a narrow sense, the device which delivers the lower thread is formed of the thread guide 20, and the device which delivers the upper thread is formed of the take-up coil 25. The line of the shortest possible, non-influenced and undisturbed thread path is shown in phantom at 28. The reason for showing the line 28 in phantom is to signify that the thread path has already been disturbed, and the thread per se has been severed into an upper thread and a lower thread.

The apparatus 11 includes two plates 29 and 30 which are fastened to the machine frame 12 and carry a vortex chamber 31. The vortex chamber 31 has a cylindrical inner chamber 32. An elongated slot 33 permits the insertion and removal of the textile threads to be joined or connected. The elongated slot 33 flares outwardly frontwards in a funnel-like manner with beveled surfaces 34 and 35. As shown in FIG. 3, rims 36 and 37 at the ends of the inner chamber 32 are likewise bevelled and rounded at the edges 38 and 39. A channel 40 serving to feed-in compressed air extends tangentially into the interior space 32 of the vortex chamber 31. The channel 40 is contined as a pipe 41.

In FIGS. 1 and 2 of the drawing, there is shown a pivotable thread holder 42 which serves for receiving and holding fast the thread end 24*a* of the upper thread 24. The thread holder 42 is hollow and is connected through a swivel joint 43 to an otherwise non-illustrated underpressure or negative pressure line. The thread holder 42 has a suction slot nozzle 44 which serves for receiving the upper thread from the take-up coil 25 after the thread holder 42 has swung into the position 42*a* thereof shown in phantom.

Another pivotable thread holder 45 serves to receive and hold fast the thread end 18*a* of the lower thread 18. The thread holder 45 is likewise hollow and is connected to the same non-illustrated underpressure or negative pressure line by means of swivel joint 46. The pivotable thread holder 45 has a suction nozzle 47, which is closed with spring force by a controllable clamping lid 48.

To receive the lower thread, the thread holder 45 is swung into the position 45*a* thereof shown in phantom, the suction nozzle 47 thereby reaching the proximity of the thread guide 20, and the clamping lid 48 is simultaneously opened by striking against a lid opener 49. In this thread holder position 45*a*, a lower thread 18 that has broken, for example, at a location above the thread brake 22, can be sucked into the suction nozzle 47 and clamped between the clamping lid 48 and the edge of the suction nozzle 47 and entrained when the thread holder 45 is swung back into the rest position thereof shown in solid lines in FIG. 2.

In FIG. 1, there is shown the travel path of the thread after the lower thread 18 has been inserted into the vortex chamber 31 by the thread holder 45 and the upper thread 24 has been inserted therein by the thread holder 42.

The drawings show that a thread clamping device 50 is disposed above the plate 29 at a distance from the vortex chamber 31, and a thread clamping device 51 below the plate 30. Each of these thread clamping devices is of tripartite construction. The thread clamping device 50 has a thread clamp 52 for clamping the upper thread 24 and a thread clamp 53 for clamping the lower thread 18. Both thread clamps can be pressed against a common center piece 54 and thereby clamp the respective threads 24 and 18. The thread clamps 52 and 53 are pivotally mounted at a swivel joint 55. The thread clamp 52 is movable by means of a lever 56, and the thread clamp 53 by means of a lever 57. The movement of the thread clamps 52 and 53 is effected by a control shaft 57*a* which carries several discs provided with control cams, of which the disc 58 with a control cam 59 is visible in FIG. 1. The control movements imparted by the disc 58 are transmitted by a control linkage 60 to the thread clamp 53 and by a control linkage 61 to the thread clamp 52.

The movements of the thread holders 42 and 45 are controlled in a similar manner by control shafts, cams and control linkages.

The thread clamping device 51 has a thread clamp 62 for clamping the upper thread 24 and a thread clamp 63 for clamping the lower thread 18. Both thread clamps 62 and 63 can be pressed against a common center piece 64. Control of the thread clamps 62 and 63 is likewise effected from the control shaft 57*a* in a manner similar to the control of the thread clamps 52 and 53.

In FIGS. 1, 2 and 4 to 7 of the drawings, there is further visible a double-armed thread regulator 65. The thread regulator 65 has a bent arm 66 which can swing into the travel path of the thread between the vortex chamber 31 and the plate 29. Similarly, a second arm 67 can swing into the travel path of the thread between the vortex chamber 31 and the plate 30. The arms 66 and 67 of the thread regulator 65 are fastened to a shaft 68 which is supported in bearings in the plates 20 and 30 by two journals 69 and 70, respectively. The double-armed thread regulator 65 can be swung by means of a lever 71 from the starting position thereof shown in FIGS. 1 and 2 into the end position thereof shown in FIG. 6. When swinging back, an intermediate position shown in FIG. 7 can be assumed by the thread regulator 65. By means of a control linkage 72, the swinging motion of the thread regulator 65 is effected by the control cam of a non-illustrated disc mounted on the control shaft 57*a*.

As is apparent especially in FIGS. 3, 4 and 5 of the drawing, a thread severing device or shears 73, 74 is associated with each of the two end rims 36 and 37 of the vortex chamber 31. The thread shears 73, 74 are constructed as double scissors. A stationary cutter blade 77 can be fastened in the interior of a metal frame 88 by means of pins 75 and 76, as shown especially in FIG. 3. The stationary cutter blade 77 has a central bore 78, into which a support shaft 79 fits which, in assembled condition, is pressed into a corresponding bore 80 formed in the vortex chamber 31. Two other parts, namely, a thread gripper 81 with two oppositely directed projections 82 and 83 and a double-edged movable cutter blade 84 are additionally mounted on the support shaft 79. A pin 85 connected to the thread gripper 81 fits into a corresponding hole 86 formed in the movable cutter blade 84. Simultaneously, the pin 85 forms an articulating connection with a control rod 87 which serves for controlling the thread cutters 73 and 74 and the thread gripper 81.

The control rod 87 is controllable in a manner similar to the control rods 60, 61 and 72 by the control shaft 57*a*.

Special thread guide means are associated with the thread cutters 73 and 74. These guide means are formed of a metal frame 88, in which, on the one hand, the support shaft 79 is supported and by which, on the other hand, the parts 77, 81 and 84 are enclosed. The parts 77, 81 and 84 are strung together with a spacer washer 89 on the support shaft 79.

The metal frame 88 has a given amount of elasticity or resilience, so that the movable cutter blade 84 is provided with a specific, adjustable contact pressure exerted against the stationary cutter blade 77 by tensioning of a compression spring 90 with a set screw 100. At the upper and lower end of the box-shaped metal frame 88, respective wedge-shaped thread dividers 101 and 102 are provided. The thread dividers 101 and 102 have a slight spacing from the end rims 36 and 37 of the vortex chamber 31 and extend toward the front beyond the elongated slot 33, in order to keep separate the threads that are to be inserted, and to prevent later the further travel of the thread twist beyond the thread dividers, when the threads are joined or connected.

Above the thread clamping device 50, there is a pivotable thread loop puller 108. The thread loop puller 108 is pivotable, by means of a swivel joint or pivot 103, which is fastened to the plate 29, in direction of the arrow 109 into a thread loop puller position 102*a* shown in phantom. This is accomplished by means of a lever 104, to which a control rod 105 is articulatingly linked. Also, this control rod 105 is actuated by the common control shaft 57*a* in the same manner as the previously mentioned control rods and control linkages.

The operation of the apparatus according to the invention will now be explained with reference to the drawing in the case of the performance of a thread joining or connecting process.

It will be assumed initially that the thread, which had been traveling along the line 28, has broken at the winding station 17. The upper thread 24 and a lower thread 18 have thus been formed. The upper thread 24 has been taken up by the take-up coil 75 and the lower thread has been held fast by the thread brake 22 in conjunction with the rake-type sensor 21.

The thread brake was ascertained in a conventional manner by nonillustrated means and was communicated to the apparatus 11 for joining or connecting textile threads. According to FIG. 2, the apparatus 11 is driven on the support tube 16 to a location in front of the winding station 17, where it starts its activity as follows:

The thread holder 42 swings into the position 42*a* thereof, where the suction slot 44 thereof seeks out the upper thread 24 on the take-up coil 24 and sucks in the end of the upper thread 24. AT the same time, the thread holder 45 swings into the position 45*a* thereof, where the clamping lid 48 is opened by the lid opener 49. Then, underpressure or negative pressure can act upon the lower thread 18, so that the lower thread 18 is sucked into the nozzle 47.

After a set short action period, both thread holders 42 and 45 swing back into the starting positions thereof as shown in solid lines in FIG. 2. The thread holder 42 holds the thread end 24*a* of the upper thread 24 solely by underpressure or negative pressure. The thread holder 45 is unable to draw the lower thread 18 from the thread brake 22 and out of the rake-type sensor 21 by underpressure or negative pressure alone. However, at the beginning of the swinging movement, the clamping lid 48 closes and clamps the lower thread 18 between the rim of the suction nozzle 47 and the clamping lid 48. Entrainment of the lower thread 18 is thereby assured.

Both thread holders 42 and 45 swing simultaneously, the rear side of the suction slot nozzle 44 entraining and deflecting the lower thread 18, as shown in FIG. 2.

During the swing of the thread holders 42 and 45, the thread clamping devices 50 and 51 are open. The thread regulator 65 is in the starting position thereof, and likewise the thread loop puller 108.

When the thread holders 42 and 45 are swung back from the positions 42*a* and 45*a*, respectively, thereof into the starting positions thereof, the threads slide into the thread clamping devices 50 and 51 and into the vortex chamber 31. It is apparent from FIG. 1 and FIG. 2 of the drawing that the lower thread 18 is guided from the supply coil or cop 19 to the thread holder 45 through the thread guide 20, the thread rake 21, the thread brake 22, the thread guide 23, over the rearside of the suction slot nozzle 44 between the thread clamp 63 and the middle member 64 of the thread clamping device 51 and through the slot 106 of the plate 30, to the right-hand side past the thread divider 102 through the interior space 32 of the vortex chamber 31, to the right-hand side past the thread divider 101 through the slot 107 of the plate 29, and through the space between the thread clamp 53 and the middle member 54 of the thread clamping device 50.

Coming from the take-up coil 25, the upper thread 24 is brought to the suction slot nozzle 44 of the thread holder 42 past the thread guide cylinder 27, between the thread clamp 52 and the middle member 54 of the thread clamping device and through the slo slot 107 of the plate 29, to the left-hand side past the thread divider 101 through the interior space of the vortex chamber 31, to the left-hand side past the thread divider 102, between the thread clamp 62 and the middle member 64 of the thread clamping device 51 and through the slot 104 of the plate 30.

Thereafter, the thread loop puller 108 is swung in direction of the arrow 109. During the swinging movement, the thread loop puller 108 grips the lower thread 18 and the upper thread 24 above the thread clamping device 50 and pulls the thread loop 110 which is disposed above the plate 29 as shown in FIG. 5.

Figure 6:
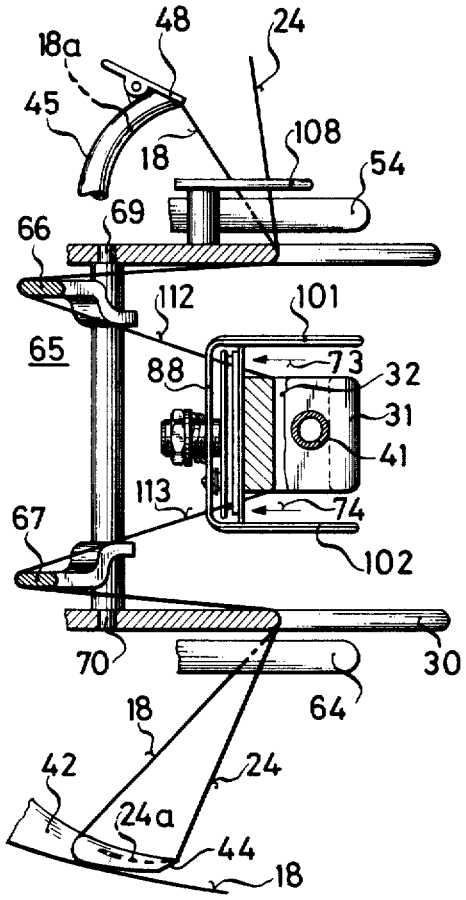

Then, the thread regulator 65 swings from the starting position thereof in direction of the arrow III (FIG. 1) into an end position thereof which is shown in FIG. 6. The instant the thread regulator 65, during the swinging movement thereof has assumed the position shown in FIG. 5, the thread loop puller 108 is swung back again in direction opposite that of the arrow 109 (FIG. 1), whereby the thread length of the upper thread 24 and the lower thread 19 stored in the thread loop 110 is again released.

When the thread regulator 65 has reached the end position thereof shown in FIG. 6, the thread loops 112 and 113 have been formed. The upper and the lower thread are looped around the two end rims of the vortex of the vortex chamber 31. The thread loop puller 108 is now in the starting position thereof again. Whereas the thread reserve for forming the thread loop 112 is supplied by the breaking-up or loosening of the thread loop 110, the thread length for forming the thread loop 113 comes directly from the supply coil or cop 19 or from the suction slot nozzle 44 of the thread holder 42.

The instant the thread loops 112 and 113 are formed, the part of the lower thread 18, which is situated between the vortex chamber 31 and the thread holder 45, ready for subsequent severance, extends upwardly to the metal frame 88 at the right-hand side, as shown in FIG. 3. Similarly, the part of the upper thread 24 situated between the vortex chamber 31 and the thread holder 42 lies on the metal frame 88 at the left-hand lower side, likewise ready to be cut off later, as shown in FIG. 3. The metal frame 88 prevents the threads from touching the two cutting knife halves prior to the controlled severance.

Figure 7:
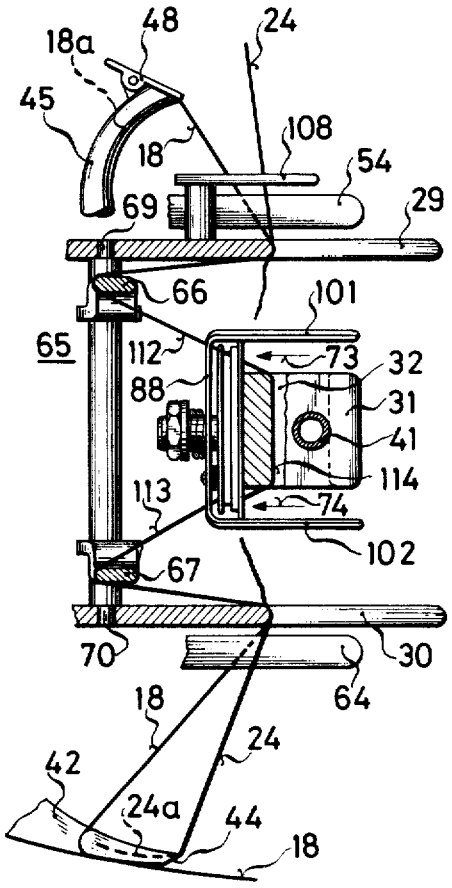

When the thread regulator 65 has reached the end position thereof shown in FIG. 6, the thread clamping devices 50 and 51 become closed. The insertion of the textile threads into the vortex chamber is thereby initially completed. Then, the thread regulator 65 swings back a short distance in direction opposite that of the arrow 111 into an intermediate position thereof shown in FIG. 7. In this intermediate position, the thread loops 112 and 113 are first loosened somewhat. Then, compressed air is blown into the interior space 32 of the vortex chamber 31 through the pipe 41. In this process, the adjacent threads are joined together or connected by the twisting and mixing of the individual fibers thereof, during which time they are in contact with the end rims of the vortex chamber 31, which results in especially good joining or connection of the threads. The threads dividers 101 and 102 advantageously prevent further propagation or travel of the thread twist. This also facilitates subsequent cutting-off or severance of the thread ends. During the exactly determined vortex period, a false twist in direction of the air vortex is forced upon the threads. This false twist causes the previously loosened thread loops 112 and 113 to be subjected again to tension. This facilitates the subsequent cutting-off or severance of the thread ends in the vicinity of the joint or connection point 114 of the textile threads 18 and 24. FIG. 7 depicts the instant of severance. To sever the thread ends, the control rod 87 is drawn in direction of the arrow 115, whereby, initially, the projections 82 and 83 seize the threads and, then, the cutter blade 84 presses the threads against the cutter blade 77, resulting in the severing action.

The instant the excess thread ends are severed, the thread regulator 65 is swung back into the starting position thereof, while the two thread clamping devices 50 and 51 are opened. The instant the thread clamping devices 50 and 51 open, the thread ends 18*a* and 24*a* are released and can be sucked away completely through the suction slot nozzle 44 of the thread holder 42 directly, and through the suction nozzle 47 of the thread holder 45 after the clamping lid 48 is opened.

If the winding station 17, thereafter, is set into operation again, the thread snaps out of the apparatus 11 for joining or connecting textile threads, due to the reinstituted winding tension and assumes a travel path according to the line 28 in FIG. 2. The activity of the apparatus 11 is then at an end. The apparatus 11 can then travel farther to another deployment location.

As noted hereinbefore, the invention is not limited to the illustrated and described embodiment. The thread cutter can also be constructed, for example, as a single scissors or shears. The thread clamping devices can be completely separated for each thread. However, if desired, a thread clamp without a middle member common to both threads can also be provided above and below. The formation of the thread loops at the end rims of the vortex chamber 31 can also be effected by means of different mechanical or pneumatic devices. The expressions "lower thread" and "upper thread" are not bound to the terms "top" and "bottom" herein. Lower thread has, in fact, been used to designate any thread which comes from a supply coil or cop or from a thread forming device. The upper thread is merely any thread leading to a take-up coil or a wind-up coil. The travel direction of the thread can be from the bottom to the top, as is the case in the illustrated embodiment. However, the thread can also run in the opposite direction or can assume a horizontal or, generally, any desired path in space.

All parts coming into contact with the threads should advantageously be well smoothed and have low friction. A wear-resistant surface is desirable for more highly stressed parts.

There are claimed:

1. Method of joining textile threads by means of an apparatus having a vortex chamber formed with an elongated slot for introducing therein threads that are to be joined, the threads being insertable into the vortex chamber adjacent one another and being held by clamping devices outside the vortex chamber, the threads being twistable together in the vortex chamber by compressed air supplied thereto and being thereby joined, which comprises inserting the threads to be joined loosely and without tension into the vortex chamber so as to be looped about opposite end rims of the vortex chamber; twisting together the threads disposed loosely and without tension in the vortex chamber while they are tightly held by the clamping devices, and slackening the thread tension to such an extent that a false twist imposed on the textile threads during twisting together of the threads and consequent shortening of the thread length causes the textile threads to come into contact with the end rims of the vortex chamber.

2. Method according to claim 1 which comprises receiving and holding fast a thread end of a take-up thread by means of a pivotable thread holder and receiving and holding fast a thread end of a supply thread by means of another pivotable thread holder for inserting the respective threads into the vortex chamber; from a starting position, placing the arms of a double-armed thread regulator at opposite sides of the vortex chamber against the threads projecting beyond the end rims of the vortex chamber and bringing the thread regulator into an end position thereof wherein the threads have become looped about the end rims of the vortex chamber; simultaneously closing the thread clamping devices that had remained open until then; returning the thread regulator to an intermediate position between the end position and the starting position thereof; thereafter performing the twisting together of the threads in the vortex chamber by supplying compressed air into the vortex chamber; reopening the thread clamping devices; and severing, at a location beyond the twisted-together connection, the thread ends that remain held by the pivotable thread holders.

3. Apparatus for performing a method of joining textile threads comprising a vortex chamber formed with a cylindrical inner space, an elongated slot through which the textile threads to be joined are insertable into the inner space of the vortex chamber and a channel terminating tangentially at said cylindrical inner space for supplying compressed air thereto, said vortex chamber having end rims at opposite ends of the cylindrical inner space, respective thread clamping devices disposed outside each of the opposite end rims of said vortex chamber, a double-armed thread regulator movable between said vortex chamber and said thread clamping devices automatically from a starting position to an end position and from the latter position to an intermediate position and back again to said starting position so as to intersect a travel path of the threads to be joined for forming loops thereof at said end rims of said vortex chamber; and respective thread severing means for severing respective ends of the textile threads, said thread severing means, respectively, being disposed in the travel path between the arms of said double-armed thread regulator and both of said end rims of said vortex chamber.

4. Apparatus according to claim 3 wherein said thread severing means, respectively, are located directly at said end rims of said vortex chamber.

5. Apparatus according to claim 3 wherein said thread severing means comprise a double shears having a movable severing knife pivotally mounted on a central support shaft.

6. Apparatus according to claim 3 including thread guide means operatively associated with said thread severing means.

7. Apparatus according to claim 3 wherein said vortex chamber is formed with outwardly flaring beveled surfaces and rounded edges at said end rims and said elongated slot.

8. Apparatus according to claim 3 wherein each of said thread clamping devices has a first movable, controllable thread clamp for one of the threads to be joined, a second movable, controllable thread clamp for the other of the threads to be joined, and a stationary middle member for separating the threads from one another and for cooperating in common with both said first and second clamps to clamp the threads therebetween.

9. Apparatus according to claim 3 wherein a line along a shortest possible uninfluenced thread travel path between a device for supplying one of the threads to be joined and a device for withdrawing the other of the threads to be joined extends outside said vortex chamber and in front of the apparatus for joining the threads.

10. Apparatus according to claim 3 including thread holding means for receiving and holding fast one of the threads to be joined and a thread loop pulling device disposed in the travel path of the one of the threads to be joined said thread loop pulling device being controllable and coordinated with a course of travel of said thread holding means for the one thread to be joined.

* * * * *